US012344288B2

(12) United States Patent
Faas

(10) Patent No.: US 12,344,288 B2
(45) Date of Patent: Jul. 1, 2025

(54) COUPLER DEVICE FOR A COUPLING, IN PARTICULAR OF A RAIL VEHICLE

(71) Applicant: Faiveley Transport Schwab AG, Schaffhausen (CH)

(72) Inventor: Stefan Faas, Appenzell (CH)

(73) Assignee: Faiveley Transport Schwab AG, Schaffhausen (CH)

( * ) Notice: Subject to any disclaimer, the term of this patent is extended or adjusted under 35 U.S.C. 154(b) by 863 days.

(21) Appl. No.: 17/452,408

(22) Filed: Oct. 27, 2021

(65) Prior Publication Data

US 2022/0144323 A1 May 12, 2022

(30) Foreign Application Priority Data

Nov. 9, 2020 (CH) ..... 01437/20

(51) Int. Cl.

| | |
|---|---|
| ***B61G 9/04*** | (2006.01) |
| ***B61G 7/12*** | (2006.01) |
| ***B61G 9/06*** | (2006.01) |
| ***B61G 9/24*** | (2006.01) |
| ***B61G 11/16*** | (2006.01) |

(Continued)

(52) U.S. Cl.

CPC ..... *B61G 9/04* (2013.01); *B61G 7/12* (2013.01); *B61G 9/06* (2013.01); *B61G 9/24* (2013.01); *B61G 11/16* (2013.01); *B61G 7/14* (2013.01); *B61G 9/10* (2013.01)

(58) Field of Classification Search

CPC ..... B61G 7/14; B61G 11/16; B61G 9/10
USPC ..... 213/75 R
See application file for complete search history.

(56) References Cited

U.S. PATENT DOCUMENTS

| | | | |
|---|---|---|---|
| 4,064,998 | A | 12/1977 | Dilg et al. |
| 11,059,501 | B2 | 7/2021 | Eisele |

(Continued)

FOREIGN PATENT DOCUMENTS

| | | | |
|---|---|---|---|
| CN | 102343918 | B | 2/2012 |
| CN | 203996265 | U | 12/2014 |
| JP | 5544019 | S | 3/1980 |

(Continued)

OTHER PUBLICATIONS

European search report for European Patent Application No. 20 20 7583 dated Mar. 25, 2021.

*Primary Examiner* — Zachary L Kuhfuss
*Assistant Examiner* — Heaven R Buffington
(74) *Attorney, Agent, or Firm* — Brian Roffe

(57) ABSTRACT

Coupler device for a coupling, in particular of a rail vehicle, is provided with a drawbar with spring elements mounted thereon in order to dampen the tension and pressure forces incurred, with a plate arranged between these, and a support flange secured to the rail vehicle. The plate bears the drawbar and is held on the support flange and connected at its outer circumference in each case with a carrier disk, each in an opening of the support flange, by overload elements arranged adjacent to one another. The overload elements are sheared off in the event of an overload in the pressure or tension direction of the drawbar. Accordingly, a secure connection is formed between the support flange and the plate, which, in the event of a crash or an overload, can be detached in a functionally reliable manner, but which in normal operation ensures a perfect coupling linkage.

18 Claims, 2 Drawing Sheets

(51) Int. Cl.
*B61G 7/14* (2006.01)
*B61G 9/10* (2006.01)

(56) References Cited

U.S. PATENT DOCUMENTS

| | | | |
|---|---|---|---|
| 2007/0107623 | A1 | 5/2007 | Radewagen |
| 2012/0199545 | A1 | 8/2012 | Peckham |

FOREIGN PATENT DOCUMENTS

| | | | | | |
|---|---|---|---|---|---|
| WO | WO-2016000601 | A1 * | 1/2016 | ..... | B61G 11/00 |
| WO | WO-2016000602 | A1 * | 1/2016 | ..... | B61G 11/18 |

* cited by examiner

COUPLER DEVICE FOR A COUPLING, IN PARTICULAR OF A RAIL VEHICLE

FIELD OF THE INVENTION

The invention relates to a coupler device for a coupling, in particular of a rail vehicle, with a drawbar and a plurality of spring elements mounted on this in order to dampen the tension and pressure forces incurred. In addition, a plate is arranged between these, and a support flange which can be secured to the rail vehicle, held on which is the plate carrying the drawbar.

BACKGROUND OF THE INVENTION

A coupler device of this type is disclosed in the printed publication EP 3 385 143, which is considered to correspond to U.S. Pat. No. 11,059,501, incorporated by reference herein. The coupling head is connected to a drawbar which is connected in a jointed manner to a guide bolt of the rail vehicle, which, with its mounted spring elements, is provided in order to dampen the pressure and tension forces incurred when in the coupled state of the rail vehicle. The rotatable plate is mounted with a guide bolt in a sleeve-shaped housing, wherein it can be displaced axially in a flange.

In this situation, an overload protection is provided for, with which, in normal operation, the housing is fixed axially in the flange with opposing overload elements, such that, in the event of overload, these are sheared off by the housing, and the housing is then pushed backwards by the flange, together with the rotatable plate and the drawbar with the spring elements. This has the advantage that, after the shearing of the overload elements, such as, for example, after a collision with another vehicle, the drawbar, together with the plate and the spring elements, there is sufficient space for a displacement movement. However, on the one hand this required an elaborate structural configuration, and, on the other, has the consequence that, after the shearing of the overload elements, the spring package can only be detached together with the housing.

OBJECTS AND SUMMARY OF THE INVENTION

The invention is based on the object of avoiding these disadvantages and providing a coupler device of the type referred to in the preamble, which is of simple structural design and can be easily fitted.

This object is solved according to the invention in that the plate is connected on its outer circumference with a carrier disk in a respective opening of the support flange, in each case by means of at least two overload elements arranged adjacent to one another. In this situation, these overload elements can be sheared off in the event of an overload in the pressure or tension direction of the drawbar. It is very advantageous in this situation that at least one spring element is arranged in each case on both sides of the plate, in order to attain a suitably adapted structure of the device.

Accordingly, a secure connection is formed between the support flange and the plate, which, in the event of a crash or an overload, can be detached with functional reliability, but which in normal operation ensures a perfect coupling linkage.

The drawbar, with the spring elements mounted on it, and the plate arranged in between, can be pushed as a modular unit into the support flange, and it and the plate are connected by means of the overload elements to the carrier disks placed in the openings. In this situation the plate is constructed without pivot pins, and the housing which is present with the known coupler devices is missing, which is very advantageous with regard to technical production.

The invention also makes provision that, preferably, in the rotation axis of the coaxially arranged carrier disks, in each case securing means are provided for fixing these to the plate.

In the context of the most gradual implementation possible, it is advantageous if in each case two overload elements are placed arranged behind one another in pairs on the plate in the axial direction of the drawbar. The number, arrangement, and dimensions of the overload elements installed in the carrier disks can be adjusted from case to case in relation to the respective operational conditions.

The coupler device according to the invention also makes provision that the plate and the carrier disks arranged coaxially to it on both sides are mounted in the openings of the support flange in order to pivot about a perpendicular axis. In addition to this, the drawbar is mounted in the plate so as to carry out jointed movement, by means of a swivel joint, by means of which the drawbar can be pivoted both horizontally as well as vertically.

This allows for an adequate deflection of the drawbar, and therefore of the coupling head or the like in the mounted state on the rail vehicle.

BRIEF DESCRIPTION OF THE DRAWINGS

The invention is explained in greater detail hereinafter on the basis of exemplary embodiments and making reference to the drawings, wherein.

DETAILED DESCRIPTION OF THE INVENTION

Figure 1:
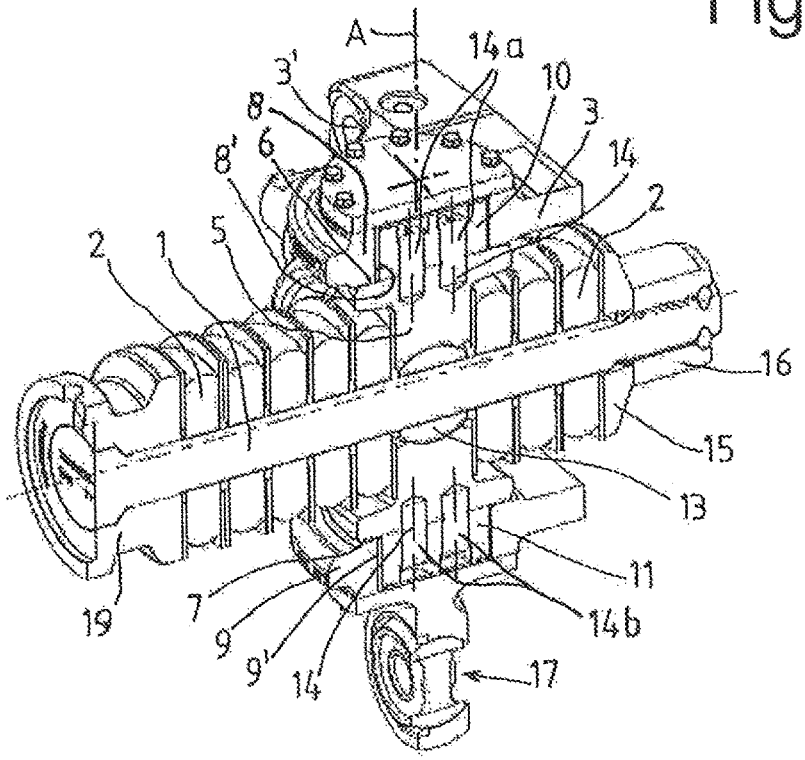
FIG. 1 shows a coupler device according to the invention in a longitudinal section through the axes of the overload elements.

The coupler device shown in FIG. 1 includes or consists essentially of a drawbar 1, which can be connected to a connecting rod, a coupling head, a spacer pipe, a spiral sleeve, an energy absorption element, or the like, with a plurality of spring elements 2 mounted on it for damping the pressure and tension forces incurred when in the coupled state. In addition, provision is made for a support flange 3, which can be secured to a vehicle box or the like of the rail vehicle, these not being shown in any greater detail, which is provided with openings 3' for its securing. The drawbar 1 is mounted in this situation in a plate 5 arranged between these spring elements 2. Such a coupler device is well-suited for rail vehicles of all kinds, such as for passenger coaches, goods wagons, locomotives, or vehicles for other purposes.

According to the invention, the plate 5 is connected on its outer circumference in each case to a carrier disk 10, 11, in each case in an opening 8', 9' of the support flange 3, by means of at least two adjacently arranged overload elements 14*a*, 14*b*, wherein these overload elements 14*a*, 14*b* are arranged with their axes 14 parallel to one another in one plane in the direction of the drawbar 1, and which can be sheared off in the event of an overload in the pressure or tension direction of the drawbar. These overload elements could, however, also be arranged as parallel and in one plane.

The sectional plane shown along the axes 14 of the overload elements 14*a*, 14*b* arranged in pairs is arranged at a distance interval from the rotation axis A of the carrier disks 10, 11, and the longitudinal axis of the drawbar respectively.

Figure 2:
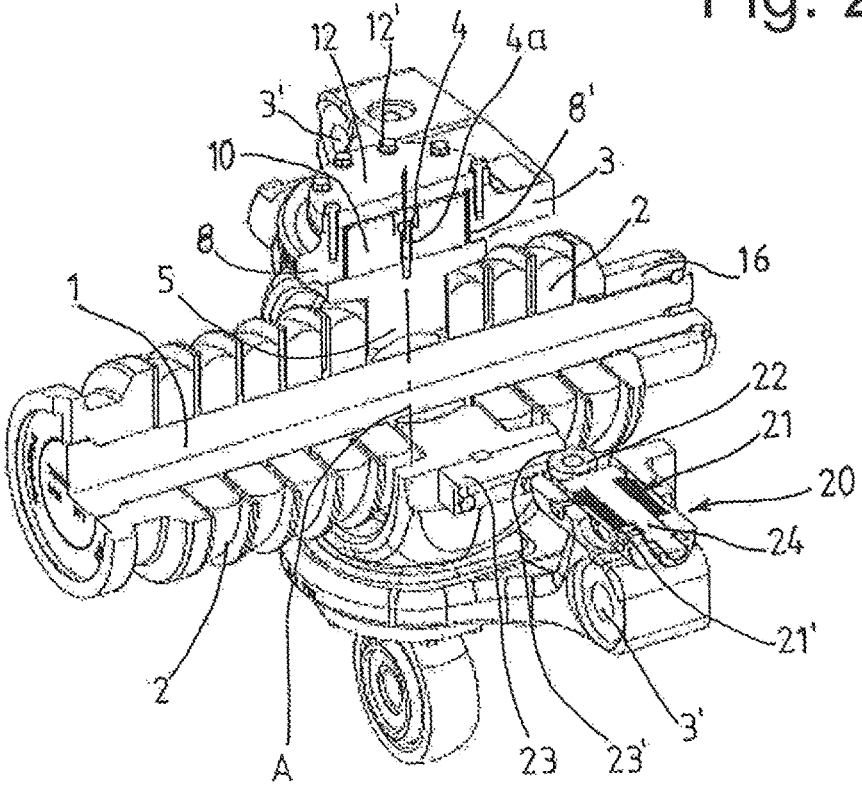
FIG. 2 shows the coupler device according to FIG. 1 in a longitudinal section offset at an angle to the longitudinal axis of the drawbar.

According to FIG. 2, the coaxially arranged carrier disks 10, 11, and the plate 5, which are located in these openings 8' of projections 8, 9 of the support flange 3, are provided with a central hole 4 in the axial direction A, in which in each case a detachable securing means 4*a* is provided for fixing them to the plate 5. This securing means 4*a* is preferably a screw, and serves primarily as a fitting aid. It could also be screwed in at another position than that represented, and it would be possible for several of these to be used per carrier disk 10, 11. In the event of an overload, these securing means 4*a* are likewise sheared off.

The spring elements 2, arranged in rows on both sides of the plate 5, are fitted on one side with five pads in the pressure direction, and on the other with three pads in the tension direction. This number can be varied, depending on the circumstances, between, in front of, and behind the plate, in each case by at least one spring element 2, or, as represented, more than two.

Accordingly, the drawbar 1, preassembled to form one unit, can be pushed together with the spring elements 2 and the plate 5 located between them, into the support flange 3 secured to the rail vehicle, and then secured in it by these overload elements 14*a*, 14*b*, by being secured in the holes in the plate 5.

These overload elements 14*a*, 14*b* are preferably configured as shear bolts or shear screws. They could also be configured, however, as disks, slot nuts, or other forms, and are provided with predetermined break points in the form of grooves, and are dimensioned in such a way that, in the event of the occurrence of a predetermined overload, they are sheared off. The drawbar 1, together with the spring elements 2 and the plate 5 are pushed backwards in the event of an excessive impact force. Depending on the force of an impact, this can be overcome without significant damage to the coupling or the vehicle. Accordingly, it is possible for the number and/or dimensions of the overload elements used to be varied from case to case, such that their effectiveness can be optimally configured under the respective requirements to meet the maximum impact or tension forces.

The plate 5 comprises two diametrically arranged peripheral surfaces 6, 7, which are guided close to free of any play in projections 8, 9, flattened on the inner side, of the support flange 3. In principle, these flat peripheral surfaces could also be configured as cylindrical or similar.

Moreover, it is also possible for a closable cover 12 to be secured on the projections 8, 9, closing an opening 8', 9' in each case, which can be closed by a number of securing means 12', such as screws. With this robust securing of the cover 12, the situation is attained that, in the event of shearing, the carrier disks are securely held in the support flange, and that they can easily be replaced.

The coupler device according to the invention makes provision that the plate 5 and the carrier disk 10, 11, arranged coaxially on both sides of it are mounted such as to pivot about a perpendicular axis A in the openings 8', 9' of the projections 8, 9 of the support flange 3. The drawbar 1 is also preferably mounted in the plate 3 so as to deflect by means of a rotary joint 13. By way of indication, the rotary joint 13 is represented as a spherical sleeve at the outer circumference. Accordingly, the drawbar 1 can be pivoted both horizontally as well as vertically about a limited angle.

The spring elements 2, with the plate 5 located between them, are installed on the drawbar 1 between a front sleeve 19 and a rear locking disk 15. They can be fixed and pretensioned against the sleeve 19 by means of a nut 16 or the like, which can be screwed in at the rear end of the drawbar.

Within the framework of the invention, a mid-centering element is assigned to the support flange 3, which, at the support flange 3, comprises on at least side, or preferably on both sides, in each case a centering means 20, which consists of a spring pressure body 21 with a slide element 22 and, interacting with this, a guide rail 23, with a guide track 23'. This spring pressure body 21 comprises a pressure spring 21', a piston element 24, which moves when subjected to pressure from the spring, and mounted on which is a slide element 22, provided for preference in the form of a roller. This slide element 22 is pressed by the spring pressure body 21 onto the guide rail 23, which is secured laterally by the plate 5, and runs parallel to the longitudinal axis of the drawbar 1. This guide rail 23 could also be located directly at the plate, and its shape could be configured, depending on the desired characteristics of the mid-centering element as cylindrical, curved, or some other form.

This mid-centering element, with the two centering means 20 on both sides of the plate 5, therefore interact in such a way with the unit formed by the drawbar 1 and the plate 5 in such a way that the drawbar 1 is positioned with its longitudinal axis, in the unloaded state, in a horizontal alignment always approximately in the longitudinal direction of the rail vehicle. Purposefully, these sliding elements 23 engage, in relation to the longitudinal axis of the drawbar 1, offset to the rotation axis A on the guide rail 23, such that a torque force takes effect on the plate.

In the coupled state of the device and the deflections which occur on the drawbar in travel operation, or with a rotation of the plate 5, the guide rails 23 are pivoted in opposite directions, and in consequence the spring pressure bodies 21 are in each case pressed further together on one side by the slide element 22, and relaxed on the other side. When the coupler device is released, the drawbar 1 is again adjusted horizontally into the middle.

The support flange 3 can comprise, in the radial elongation of the projection 9, a connection arm, connected to it in a bearing 17 and aligned preferably parallel to the drawbar, with a pressure spring exerting pressure on it in the longitudinal direction, which is not represented in any greater detail. This couples the support flange 3 to the drawbar 1 in such a way that a supporting pressure force is produced, by means of which it, and the coupling head connected to it, are centered at a predetermined height position. Such a connection arm is explained in detail in the European Application No. 19 214 224.8, and is therefore not described in any greater detail hereinafter.

In the event of a collision with an obstacle or another vehicle, the drawbar 1 is subjected to overload forces, which, on reaching a predetermined intensity, cause the overload elements to shear off. As a result, the drawbar 1, together with the spring package 2 and plate 5, are pushed backwards through the opening in the support flange 3, which is flush with the outer profile of the plate, into a vehicle box of the rail vehicle. As a result, after a crash the spring package can be taken back into use without any great effort, inasmuch as no irreversible damage has been incurred.

Figure 3:
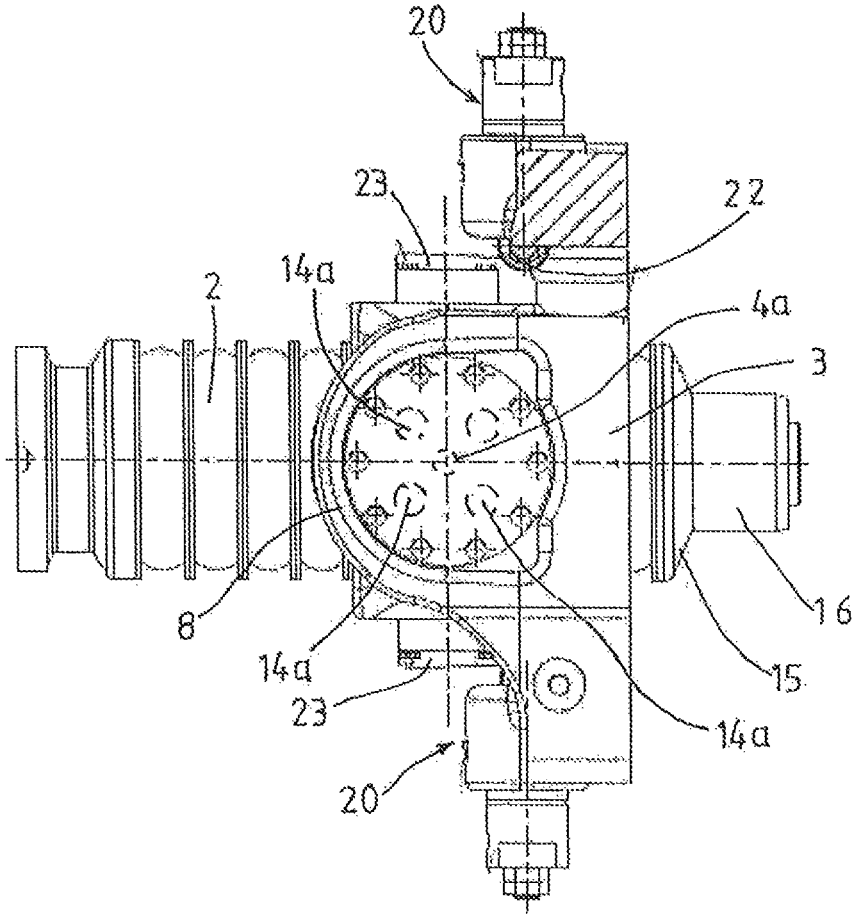
FIG. 3 is a view from above of the coupler device according to FIG. 1.

According to FIG. 3, for the connection of the carrier disks 10, 11 to the plate 5, in each case four overload elements 14*a*, 14*b* are provided, which are arranged in pairs with their axes 14 parallel to one another and in the plane in the direction of the drawbar. Advantageously, these four overload elements 14*a*, 14*b* are arranged symmetrically and at the same distance interval from the axis A. In addition, the centric arrangement of the securing means 4*a*, the cover 12, and the number of its securing means 12' can be seen.

The invention has been adequately disclosed by the foregoing exemplary embodiments. It could, however, also be disclosed by further variants. For example, the carrier disks could be fixed in the respective opening of the support flange. The number of the overload elements with a respective carrier disk amounts to at least two. These could in principle be arranged on the plane of the longitudinal axis of the drawbar.

The invention claimed is:

1. A coupler device for a coupling, comprising:

a drawbar, a plurality of spring elements mounted on the drawbar for damping tension and pressure forces, a plate arranged between the spring elements such that at least one of the spring elements is on each side of the plate, a support flange configured to be secured to a rail vehicle, the plate being mounted on the drawbar and held on the support flange, the support flange comprising two projections each having an opening, and two carrier disks, the plate being connected at an outer circumference of the plate to each of the carrier disks in a respective one of the openings of the support flange by at least two respective overload elements arranged next to one another, the overload elements being configured to be sheared off in the event of an overload in a pressure or tension direction of the drawbar, and wherein a mid-centering element is assigned to the support flange, which interacts with a unit formed by the drawbar and the plate such that the drawbar is adjustable with a longitudinal axis of the drawbar, in an unloaded state, being in a horizontal alignment, and wherein the mid-centering element comprises, at the support flange, at least one centering means comprising a spring pressure body with a sliding element and a guide rail interacting with the spring pressure body.

2. The coupler device according to claim 1, wherein in an axis (A) of the carrier disks, plate securing means is provided for fixing the carrier disks to the plate.

3. The coupler device according to claim 2, wherein the overload elements are arranged in pairs with their axes parallel to one another, and are arranged in the plane in the axial direction of the drawbar.

4. The coupler device according to claim 2, wherein the plate securing means comprise a respective screw that fixes each of the carrier disks to the plate.

5. The coupler device according to claim 2, wherein a plane formed by the overload elements is located at a distance interval from the axis (A) of the carrier disks.

6. The coupler device according to claim 1, wherein the drawbar is mounted in the plate by a swivel joint to enable the drawbar to be deflected.

7. The coupler device according to claim 1, further comprising:

two covers each closing an outside of a respective one of the openings; and securing means for securing each of the covers to a respective one of the projections.

8. The coupler device according to claim 7, wherein the securing means comprise a plurality of screws.

9. The coupler device according to claim 1, further comprising plate securing means for fixing the carrier disks to the plate, wherein the plate and the support flange are dimensioned on the outside and the inside respectively such that the drawbar, with the spring elements mounted on the drawbar and the plate arranged between the spring elements, is configured to be pushed as one unit into the support flange, and the plate is configured to be connected by the plate securing means and the overload elements to the carrier disks placed in the openings.

10. The coupler device according to claim 1, further comprising a connection arm arranged at the support flange at a bearing in an extension of one of the projections, which is held by the support flange on one side and by the drawbar on the other, and has the effect of producing a supporting pressure force onto the drawbar, and therefore, at least, a certain centering height position of a coupling head is incurred.

11. The coupler device according to claim 10, wherein the connection arm is aligned parallel to the drawbar.

12. The coupler device according to claim 1, wherein the carrier disks are arranged coaxially to one another.

13. The coupler device according to claim 1, wherein the carrier disks are on opposite sides of the plate.

14. The coupler device according to claim 1, wherein the plate comprises two diametrically arranged peripheral surfaces that are each guided in a respective one of the projections.

15. The coupler device according to claim 1, wherein the plate and the carrier disks are configured to pivot about an axis in the openings of the projections of the support flange.

16. The coupler device according to claim 1, wherein the projections are on both sides of the support flange.

17. The coupler device according to claim 1, wherein the drawbar is configured such that a longitudinal axis of the drawbar is in a longitudinal direction of the rail vehicle when the support flange of the coupler device is secured to the rail vehicle.

18. The coupler device according to claim 1, wherein the guide rail runs parallel to the longitudinal axis of the drawbar.

* * * * *